US009482045B2

(12) United States Patent
Zhou

(10) Patent No.: US 9,482,045 B2
(45) Date of Patent: Nov. 1, 2016

(54) SEAL STRIP AND METHOD AND DEVICE FOR SEWING SAME

(71) Applicant: PANAN COUNTY KELI SEAL CO., LTD., Jinhua, Zhejiang Province (CN)

(72) Inventor: Yizhi Zhou, Jinhua (CN)

(73) Assignee: PANAN COUNTY KELI SEAL CO., LTD., Jinhua (CN)

( * ) Notice: Subject to any disclaimer, the term of this patent is extended or adjusted under 35 U.S.C. 154(b) by 116 days.

(21) Appl. No.: 14/371,486

(22) PCT Filed: Dec. 7, 2012

(86) PCT No.: PCT/CN2012/086180

§ 371 (c)(1),
(2) Date: Jul. 10, 2014

(87) PCT Pub. No.: WO2013/104225

PCT Pub. Date: Jul. 18, 2013

(65) Prior Publication Data

US 2014/0345200 A1 Nov. 27, 2014

(30) Foreign Application Priority Data

Jan. 13, 2012 (CN) ..... 2012 2 0015047 U
Oct. 19, 2012 (CN) ..... 2012 1 0400658

(51) Int. Cl.
*E06B 7/22* (2006.01)
*D05B 7/00* (2006.01)
(Continued)

(52) U.S. Cl.
CPC . *E06B 7/22* (2013.01); *D05B 7/00* (2013.01); *D05B 23/00* (2013.01); *D06H 5/00* (2013.01); *F24C 15/021* (2013.01)

(58) Field of Classification Search
CPC ..... F16J 15/02; F16J 15/18; F16J 15/027; F24C 15/021; E06B 7/22; E06B 7/16; E06B 7/232; D05B 7/00; D05B 35/06; D05B 23/00; D06H 5/00
See application file for complete search history.

(56) References Cited

U.S. PATENT DOCUMENTS 747,448 A * 12/1903 Lomasney ..... B29C 66/1142 277/631
3,507,234 A * 4/1970 Bryan ..... D05B 3/007 112/470.33

(Continued)

FOREIGN PATENT DOCUMENTS

CN 201461948 U 5/2010
CN 202441232 U 9/2012

(Continued)

*Primary Examiner* — Ismael Izaguirre
(74) *Attorney, Agent, or Firm* — Jiwen Chen

(57) ABSTRACT

Disclosed is a seal strip, comprising a tubular seal strip body with a first end (116) and a second end (117), wherein the first end (116) extends into the second end (117) and is securely connected to the second end (117) by a sewing thread (113). Further disclosed are a method and a device for sewing the seal strip, wherein the sewing device comprises a seal strip feeding machine (1), a device (2) for positioning the ends of the seal strip, a device for inwardly folding an edge of the seal strip, a device (3) for butt-joining the ends of the seal strip, a device (5) for threading a needle for the seal strip, and a device (4) for sewing the seal strip. The two ends of the seal strip are securely connected by the sewing thread, providing a high connection strength; and the method and device for sewing the seal strip can accomplish complete automation in sewing the seal strip, thus greatly improving efficiency during the production and processing of the seal strip.

8 Claims, 14 Drawing Sheets

(51) Int. Cl.

| | |
|---|---|
| ***D05B 23/00*** | (2006.01) |
| ***F24C 15/02*** | (2006.01) |
| ***D06H 5/00*** | (2006.01) |

(56) References Cited

U.S. PATENT DOCUMENTS 3,812,316 A * 5/1974 Milburn ..... F24C 15/021 174/358
4,541,203 A * 9/1985 Naffrechoux ..... F24C 15/04 126/200
5,066,028 A 11/1991 Weil
5,570,648 A * 11/1996 Burt ..... D05B 3/00 112/305
2002/0079039 A1* 6/2002 Azulay ..... A41D 27/245 156/73.1
2003/0001344 A1 1/2003 Bono, Jr. et al.
2004/0026874 A1 2/2004 Flasher

FOREIGN PATENT DOCUMENTS

CN 104542755 A * 4/2015
JP 7-331521 A 12/1995

* cited by examiner

SEAL STRIP AND METHOD AND DEVICE FOR SEWING SAME

This is a U.S. national stage application of PCT Application No. PCT/CN2012/086180 under 35 U.S.C. 371, filed Dec. 7, 2012 in Chinese, claiming the priority benefits of Chinese Application No. 201220015047.1, filed Jan. 13, 2012 and Chinese Application No. 201210400658.2, filed Oct. 19, 2012, which are hereby incorporated by reference.

FIELD OF THE TECHNOLOGY

The present invention relates to a processing equipment and a processing method of a seal strip, particularly to a seal strip, a method and a device for sewing the same.

BACKGROUND OF THE TECHNOLOGY

The doors of electric appliances such as ovens, refrigerators, microwave ovens and clothing dryers should be normally closed with tubular seal strips around the peripheries of the doors, so as to ensure good airtightness.

Such kind of seal strip is generally comprised of an inner supporting tube (inner layer) and an outer tube (outer layer), wherein the inner supporting tube is woven with metal wires and the outer tube can be woven with insulation/thermal materials like glass fiber. Such kind of seal strip can still have strong mechanical strength and good airtightness after long-term use under high temperature, since the inner supporting tube can provide the seal strip with strength and the outer insulation/thermal material makes the seal strip suitable for use under high temperature.

The door panels of various electric appliances are different in their specifications, so are the seal strips; when the electric appliance is cut off, the ends of the seal strips shall be connected into a ring form. The current method is to connect the ends with two clips.

The Chinese utility model Application No.: 200920120533.8 discloses a clip designed for an oven door seal strip, which is made with one flexible and elastic metal wire or other proper materials, comprising of a head part matched with the mounting surface, a neck part and a base. The base is vertical to the head part and connected at the neck part, being in the coiled spiral shape on one plane, with a gap between the first terminal of the metal wire and its adjacent inner metal wire.

Such means of connection with clips is insufficient in strength and is undesirable when clips are not required for mounting a seal strip.

The utility model Application No.: 201220015047.1 discloses a seal strip for sealing of an electric appliance door, comprising a tubular seal strip body with a first end and a second end, wherein the first end extends into the second end and is securely connected to the second end by a sewing thread.

In the present art, the ends of the seal strip are sewed manually with low efficiency.

SUMMARY OF THE INVENTION

Technical Problems

The present invention provides a seal strip, a method and a device for sewing the seal strip, solving the problem of insufficient strength at joints of the seal strips, accomplishing complete automation in sewing the seal strip, and thus greatly improving the efficiency in sewing the seal strip.

Solution to the Problems

The technical solution is a seal strip comprising a tubular seal strip body with a first end and a second end, wherein the first end extends into the second end and is securely connected to the second end by a sewing thread.

An outer circumference of the first end fits to an inner circumference of the second end.

A part of the second end is inwardly folded to form a double-deck structure area which is securely connected to the first end by a sewing thread.

The outer circumference of the first end is in contact with an inner circumference of the double-deck structure area.

The tubular seal strip body is comprised of an inner tubular metal net and an outer glass fiber casing.

The present invention also relates to a method for sewing the seal strip, comprising the following steps:

(1) inserting and connecting the two ends of the seal strip to form an inserting part;
(2) penetrating the inserting part with the sewing thread along the radial direction of the seal strip;
(3) rotating the inserting part to the predetermined angle around the axis of the seal strip;
(4) penetrating the inserting part with the sewing thread in the reverse route against that in step (2);
(5) repeating steps (2)-(4) until the sewing of the seal strip is completed.

The present invention also provides a device for sewing the seal strip, including a rack, comprising:

a device for positioning the ends of the seal strip to position the first end and the second end of the seal strip;

a device for butt-joining the ends of the seal strip, comprising a first fixture and a second fixture to clamp the first end and the second end of the seal strip, respectively.

The first fixture comprises:

a limit slot fixed on the rack;

a clamp cover hinged on the rack and matched with the limit slot;

The second fixture comprises:

two parallel limit strips fixed on the rack;

a mobile table arranged on the rack;

a lower chuck fixed on the mobile table, which is an arc supporting spring positioned between the two limit strips;

a swinging arm hinged with the mobile table;

an upper chuck fixed at free end of the swinging arm, which is rod-shaped, cooperates with the arc supporting spring to clamp the second end of the seal strip and gets into the first end of the seal strip along with the mobile table;

a device for sewing the seal strip, comprising a rotary fixture positioned on the rack to clamp the seal strip;

a needle dial mounted on the rack;

a first clamping jaw, which picks sewing needle from the needle dial in sliding fit with the rack;

a second clamping jaw, which cooperates with the first clamping jaw and pierces the seal strip with sewing needle by turns in sliding fit with the rack.

After positioning of the ends of the seal strip by the device for positioning the ends of the seal strip, the first end of the seal strip is positioned in the limit slot, and the clamp cover flips and, in cooperation with the limit slot, clamps the first end of the seal strip. Meanwhile, the second end of the seal strip is positioned between the two said limit strips, which means, on the arc supporting spring, and the swinging arm rotates, driving the upper chuck at free end of the swinging arm, in coordination with the lower chuck, and clamps the second end of the seal strip. Thus, the mobile table moves and drives the second end of the seal strip to get into the first end of the seal strip.

After butt-joining the ends of the seal strip, the butt-joining part of the seal strip is positioned in the rotary fixture, wherein the first clamping jaw picks a sewing needle from the needle dial, slides and pierces the butt-joining part of the seal strip with the sewing needle. The second clamping jaw clamps the sewing needle and threads across one end of the seal strip, while the first clamping jaw loosens the sewing needle and the second clamping jaw clamps the sewing needle, slides away from the seal strip for a certain distance, and immediately returns. When the rotary fixture rotates to a certain angle, the second clamping jaw pierces the seal strip with the sewing needle and the first clamping jaw clamps the other end of the sewing needle, while the second clamping jaw loosens the sewing needle and the first clamping jaw clamps the sewing needle, slides away from the seal strip for a certain distance, and immediately returns. When the rotary fixture rotates to a certain angle, this process repeats again and again until sewing of the butt-joining part of the seal strip is finished.

The first clamping jaw and the second clamping jaw clamp the sewing needle in turn, with the position of clamping the sewing needle getting close to the seal strip in turn. After the last sewing and tensioning the sewing thread, the sewing needle drops automatically, and the first clamping jaw, the second clamping jaw and the rotary fixture reset.

It is preferred that a seal strip feeding machine which provides seal strips to the device for positioning the ends of the seal strip is equipped, comprising:

- multiple parallel arranged conveying rolls connected on the rack by a shaft;
- a guide plate obliquely fixed on the rack;
- a flap plate hinged with the rack, which is used to move the seal strip on the conveying rolls onto the top surface of the guide plate; and
- a seal strip receiving groove located at a bottom edge of the guide plate.

After being cut by the cutting machine, the seal strip is delivered to a certain position by the parallel arranged conveying rolls and the flap plate moves the seal strip on the conveying rolls onto the top surface of the guide plate, and then the seal strip slides down to the seal strip receiving groove located at bottom edge of the guide plate along the oblique top surface of the guide plate.

Actuating signal of the flap plate may be given out by a position sensor positioned at one side of the conveying rolls. After sensing the signal of the seal strip, the position sensor gives out signal to the flap plate which actuates and throws the seal strip onto the top surface of the guide plate.

Actuating signal of the flap plate may also be controlled by time, with the time interval of actuation of the flap plate being preset based on the cutting speed of the cutting machine, and the flap plate will actuate and throw the seal strip onto the top surface of the guide plate in such time interval.

It is preferred that the device for positioning the ends of the seal strip comprises:

- a seal strip receiving groove fixed on the rack;
- two pressure wheels mounted on the rack for clamping and delivering the seal strip, with opposite delivering directions;
- a seal strip holding opening positioned at the bottom surface of the seal strip receiving groove;
- a three-dimensional mobile platform arranged on the rack; and
- a seal strip pickup mechanism fixed on the three-dimensional mobile platform.
- after being fed by the feeding machine, the seal strip is located in the seal strip receiving groove and the two pressure wheels clamp both ends of the seal strip respectively, transfer in opposite directions and move the ends of the seal strip to the middle. Due to the action of gravity, the middle part of the seal strip hangs from the seal strip holding opening and the two pressure wheels stop rotating when the ends of the seal strip move the appointed position. Then, the three-dimensional mobile platform moves to the appropriate position above the seal strip and the seal strip pickup mechanism picks up the seal strip.

It is preferred that a device for inwardly folding the second end of the seal strip is provided, the device comprising:

- a two-dimensional mobile platform slidably arranged on the rack; and
- a pneumatic jaw fixed on the two-dimensional mobile platform, comprising of at least three chucks driving ends of the seal strip to fold inwardly.

The first end of the seal strip is positioned in the first fixture, and when the two-dimensional mobile platform slides to an appropriate position relative to the first fixture, the pneumatic jaw clamps external of the first end of the seal strip and the two-dimensional mobile platform slides along direction of the seal strip, and then, the pneumatic jaw enters into the first end of the seal strip, and drives the first end of the seal strip to fold inwardly. After finishing folding inwardly, the two-dimensional mobile platform moves in reverse direction and the pneumatic jaw moves out of the first end of the seal strip.

Since the grip of the pneumatic jaw does not entirely clamp the end of the seal strip, the inwardly folded flange of the seal strip does not go out synchronously with the pneumatic jaw.

It is preferred that a device for threading a needle for the device for sewing the seal strip is provided, comprising:

- a sewing needle conveying mechanism;
- a three-dimensional mobile needle clamp to fetch the sewing needle from the sewing needle conveying mechanism;
- a supporting jib arm with a threading hole;
- a lead clamp positioned under the supporting jib arm to pull sewing thread from the threading hole;
- a hooked needle to stretch into the sewing needle eye to hook the sewing thread; and
- a pair of thread scissors, which is mounted on the supporting jib arm to cut the sewing thread.

The three-dimensional mobile needle clamp fetches sewing needle from the sewing needle conveying mechanism and the lead clamp pulls sewing thread from the threading hole, while the hooked needle stretches into the sewing needle eye to hook the sewing thread, the thread scissors cut the sewing thread, and the hooked needle pulls the sewing thread across the needle eye.

It is preferred that the sewing needle comprises a needle rod, needle tips at both ends of the needle rod, and a needle eye in the middle of the needle rod, wherein the section of the needle rod is rectangle.

Both ends of the sewing needle are needle tips. During the sewing process of the seal strip, the sewing thread passes through the middle needle eye and both ends of the sewing needle can pierce the seal strip for sewing operation. During the automatic sewing process of the seal strip, there is no need to adjust the moving direction of the sewing needle tip so that the automatic sewing route is concise and the sewing process is quick, thus improving the sewing efficiency of the seal strip.

It is preferred that the sewing needle conveying mechanism comprises:

a needle bin for holding sewing needles;

a needle tray positioned at bottom of the needle bin and matched with the size of a single sewing needle;

a needle sweeping wheel mounted on the side wall of the needle bin by a revolving shaft, and located at the top opening of the needle tray;

a needle pushing plate arranged at bottom of the needle tray, which is equipped with a falling needle tray on the top for receiving the sewing needle from the needle tray; and a needle pushing cylinder, which drives the needle pushing plate to move.

The sewing needle is put in the needle bin, and the width of the needle tray is comparable to the thickness of the sewing needle (i.e. the width of the rectangular section of the sewing needle). The needle sweeping wheel keeps rotating, and the sewing needle falls into the falling needle tray via the needle tray only when the thickness and the direction of the sewing needle are comparable to the needle tray, with the depth of the falling needle tray matching with the width of the sewing needle (i.e. the length of the rectangular section of the sewing needle) and the width of the falling needle tray being able to hold only one sewing needle each time. After the sewing needle is positioned in the falling needle tray, the needle pushing cylinder pushes the needle pushing plate to move and drives the sewing needle in the falling needle tray to move to an appropriate position.

The needle dial comprises:

a needle dial body and a needle dial cover;

The needle dial body is in disc-shaped with several needle holding grooves arranged in radial direction on a top surface of the needle dial body, and a needle inserting mouth on each needle holding groove stretching to outer edge of the needle dial; and The needle dial cover is positioned on the top surface of the needle dial body by a connector in coaxial.

The width of each needle holding groove is comparable to the thickness of the sewing needle, and the depth of the needle holding groove is comparable to the width of the sewing needle. Thus, the sewing needle is inserted into the needle holding groove via the needle inserting mouth, positioned in the cavity formed by the needle holding groove and the needle dial cover, and closely fits with the cavity.

Since the length of the needle holding groove is less than that of the sewing needle, after being inserted into the needle holding groove via the needle inserting mouth, only one part of the sewing needle is positioned in the needle holding groove, and the rest part is outside the needle dial body so that the sewing needle can be easily inserted and taken out. It is preferred that the length of the needle holding groove is less than a quarter of the length of the sewing needle.

The present invention also provides a method for sewing the seal strip with the device for sewing the seal strip, comprising the following steps:

(1) the second fixture clamps the second end of the seal strip and extends into the first end of the seal strip to form an inserting part;

(2) positioning the inserting part in the rotary fixture, and the first clamping jaw clamps the sewing needle and penetrates the inserting part along the radial direction of the seal strip, while the second clamping jaw clamps the sewing needle and continues to move away from the rotary fixture;

(3) the rotary fixture rotates around its axis to the predetermined angle;

(4) the second clamping jaw clamps the sewing needle and penetrates the seal strip in the reverse direction, while the first clamping jaw clamps the sewing needle and continues to move away from the rotary fixture; and (5) repeat steps (2)-(4) until the sewing of the seal strip is completed.

Beneficial Effects of the Invention

Beneficial Effects:

The disclosed seal strip, the method and device for sewing the seal strip can provide a high connection strength and accomplish complete automation in sewing the seal strip, thus greatly improving efficiency during the production and processing of the seal strip.

EMBODIMENT OF THE INVENTION

A device for sewing the seal strip in the present invention will be elaborated in details next in combination with the drawings.

Figure 29:
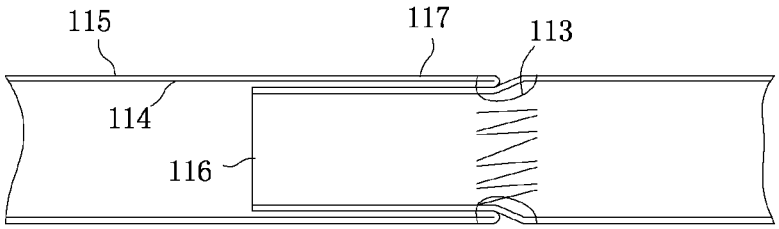
FIG. 29 shows the longitudinal sectional view of the first sewing method of the seal strip.

As shown in FIG. 29, the disclosed embodiment is a seal strip, comprising a seal strip body made from an inner tubular metal net 114 and an outer glass fiber casing 115. The seal strip body is provided with a first end 116 and a second end 117, wherein the first end 116 extends into the second end 117, and outer circumference of the first end 116 fits to inner circumference of the second end 117, and is securely connected by a sewing thread 113, providing a high connection strength and being suitable for the assembly of any door panel.

As shown in FIG. 29, a part of the second end 117 is inwardly folded to form a double-deck structure area which is securely connected to the first end 116 by the sewing thread 113, aiming to prevent the outer glass fiber casing from sleaving and affecting the appearance and sealing effect. Therefore, the inwardly folded part can only be the outer glass fiber casing instead of the tubular metal net.

Figure 30:
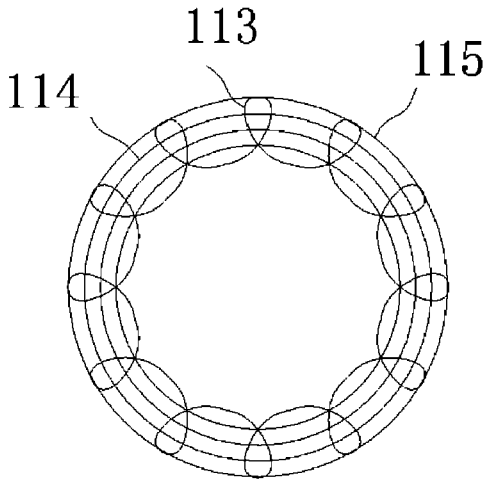
FIG. 30 shows the schematic cross-sectional view of the second sewing method of the sewing part of the seal strip.
Figure 31:
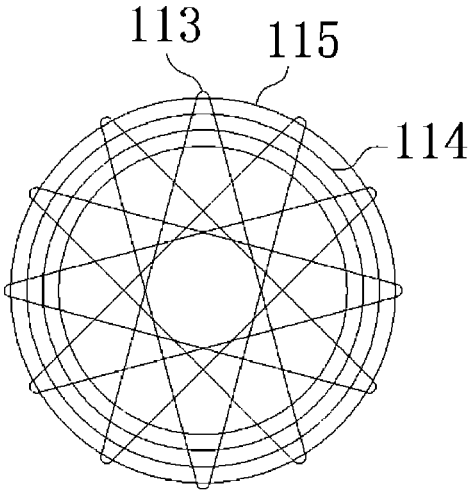
FIG. 31 shows the schematic cross-sectional view of the third sewing method of the sewing part of the seal strip.

The sewing thread 113 winds on the seal strip body for at least one circle and there are multiple sewing methods. FIG. 30 shows the second sewing method and FIG. 31 shows the third sewing method.

The disclosed is also a method for sewing the seal strip, comprising the following steps:

(1) inserting and connecting two ends of the seal strip to form an inserting part;

(2) penetrating the inserting part with sewing thread along the radial direction of the seal strip;

(3) rotating the inserting part to the predetermined angle around the axis of the seal strip;

(4) penetrating the inserting part with the sewing thread in the reverse route against that in step (2); and (5) repeating steps (2)-(4) until the sewing of the seal strip is completed.

Figure 1:
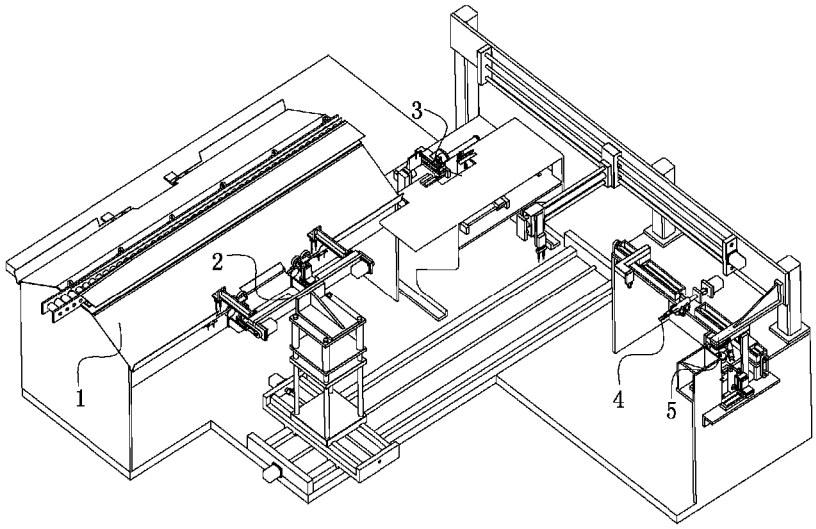
FIG. 1 shows the schematic view of the device for sewing the seal strip in the present invention.

As shown in FIG. 1, the disclosed embodiment is a device for sewing the seal strip, comprising a seal strip feeding machine 1, a device 2 for positioning the ends of the seal strip, an equipment for inwardly folding an edge of the seal strip, a device 3 for butt-joining the ends of the seal strip, a device 5 for threading a needle for the seal strip, and a device 4 for sewing the seal strip.

Figure 2:
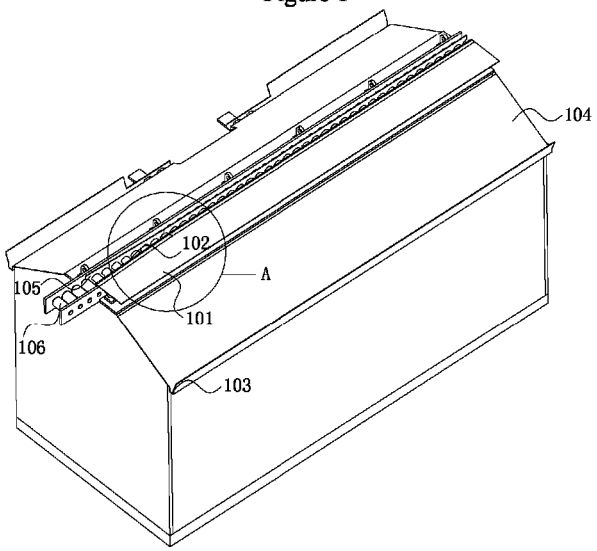
FIG. 2 shows the schematic view of the seal strip feeding machine.

As shown in FIG. 2, the seal strip feeding machine comprises a rack, multiple parallel arranged conveying rolls 106 connected on the rack by a shaft, a guide plate 104 fixed on the rack, a flap plate hinged with the rack, which is used to move the seal strip on the conveying rolls 106 onto the top surface of the guide plate 104, and a seal strip receiving groove 103 located at bottom edge of the guide plate 104.

Figure 3:
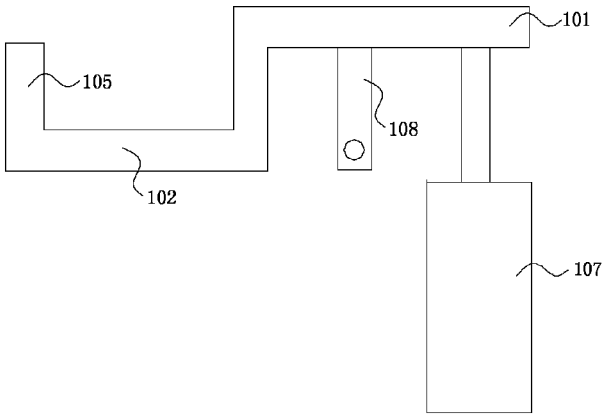
FIG. 3 shows the schematic view of the structure of the flap plate of the seal strip feeding machine.

Wherein, as shown in FIG. 3, the flap plate comprises a supporting part 108 hinged with the rack, a poking part which is positioned at one side of the supporting part 108 and extends between two adjacent conveying rolls 106, a transmitting part 101 positioned at the other side of the supporting part 108, and a flap plate cylinder 107 arranged on the rack with a piston rod of the flap plate cylinder 107 being connected with the transmitting part 101.

The poking part involves at least four driving levers 102 connected with one side of the supporting part 108, with each driving lever 102 extending between two corresponding adjacent conveying rolls 106 and the top surface of the driving lever 102 being lower than the top surface of the conveying rolls 106. All the driving levers 102 keep away from one side of the supporting part 108, and are interconnected via the interconnecting piece 105 which is vertical to the driving lever 102 and stops the seal strip from sliding from the driving lever 102 when the seal strip is thrown. The supporting part 108, the transmitting part 101 and the poking part may be respectively made and assembled, or be made as an integral structure.

The guide plate 104 is obliquely arranged with an included angle of 45-70° with the horizontal plane, so that the seal strip can slide down into the seal strip receiving groove 103 along the top surface of the guide plate 104 due to the action of gravity after being thrown by the flap plate onto the top surface of the guide plate 104.

The seal strip receiving groove 103 is U-shaped and matches with the seal strip so that the seal strip is distributed at the bottom of the U-shaped groove in straight line, which is convenient for the subsequent positioning of the ends of the seal strip.

In an embodiment, actuating signal of the flap plate may be given out by a position sensor positioned at one side of the conveying rolls 106. After sensing the signal of the seal strip, the position sensor gives out signal to the flap plate which actuates and throws the seal strip onto the top surface of the guide plate 104.

In another embodiment, the actuating signal of the flap plate may also be controlled by time, with the time interval of actuation of the flap plate preset based on the cutting speed of the cutting machine, and the flap plate will actuate and throw the seal strip onto the top surface of the guide plate 104 in such time interval.

Figure 4:
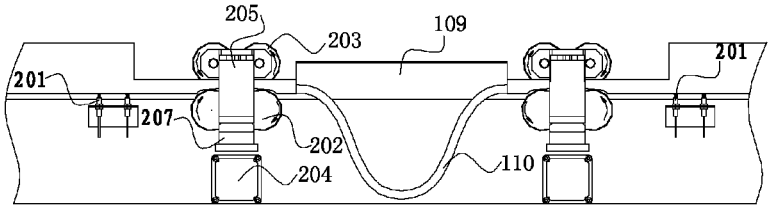
FIG. 4 shows the schematic view of the device for positioning the ends of the seal strip.
Figure 5:
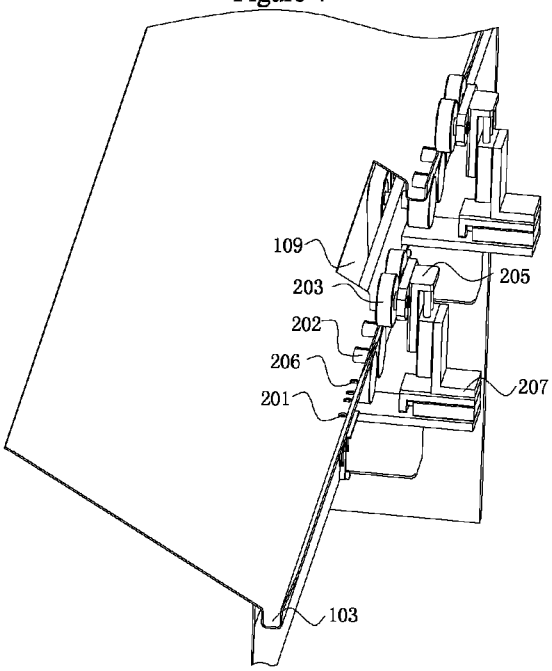
FIG. 5 shows the schematic view of the device for positioning the ends of the seal strip (oblique view)
Figure 6:
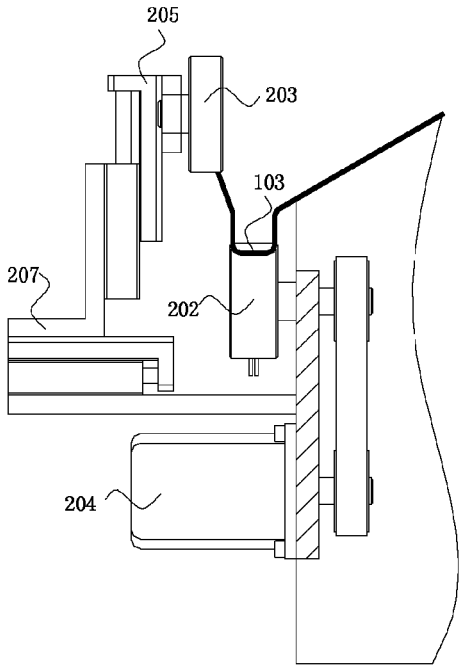
FIG. 6 shows the side view of the device for positioning the ends of the seal strip.

As shown in FIG. 4, FIG. 5 and FIG. 6, the device for positioning the ends of the seal strip comprises a seal strip receiving groove 103 fixed on the rack, two pressure wheels mounted on the rack and used to clamp and deliver the seal strip 110, a seal strip holding opening 109 positioned at the bottom surface of the seal strip receiving groove 103, a three-dimensional mobile platform 302 arranged on the rack, and a seal strip pickup mechanism fixed on the three-dimensional mobile platform 302.

The seal strip holding opening 109 is a strip-type notch arranged along length direction of the seal strip receiving groove 103, with the two pressure wheels positioned at each side of the length direction of the strip-type notch, respectively.

With two pressure wheels positioned at each side of the length direction of the strip-type notch respectively, after being clamped by the two pressure wheels respectively, both ends of the seal strip 110 start relative movement by transmission of the two pressure wheels and the middle part of the seal strip 110 hangs from the strip-type notch due to squeezing and gravity.

The two pressure wheels, i.e. the first pressure wheel and the second pressure wheel, respectively, comprise a lower pressure wheel 202 connected at the bottom surface of the seal strip receiving groove 103, a sliding seat 207 assorted with the rack, a lifting wheel seat 205 mounted on the sliding seat 207, and an upper pressure wheel 203 connected with the lifting wheel seat 205 by shaft, which matches with the lower pressure wheel 202.

The upper pressure wheel 203 and the lower pressure wheel 202 are positioned up and down the seal strip receiving groove 103, respectively, and there is an avoidance opening corresponding to the position of the lower pressure wheel 202 at the bottom surface of the seal strip receiving groove 103. At least part of outer circumference of the lower pressure wheel 202 extends above the bottom surface of the seal strip receiving groove 103 via the avoid opening, keeps direct contact with the seal strip 110, clamps the seal strip 110 together with the upper pressure wheel 203, and drives ends of the seal strip 110 to move to the appointed position due to the force of friction between the upper pressure wheel 203 and the seal strip 110, as well as that between the lower pressure wheel 202 and the seal strip 110.

A position sensor 201 sensing ends of the seal strip 110 is arranged at both sides along the length direction of the strip-type notch. The lower pressure wheel 202 is a driving wheel connected with a driving mechanism 204, for which the control signal is given by the position sensor 201.

Figure 7:
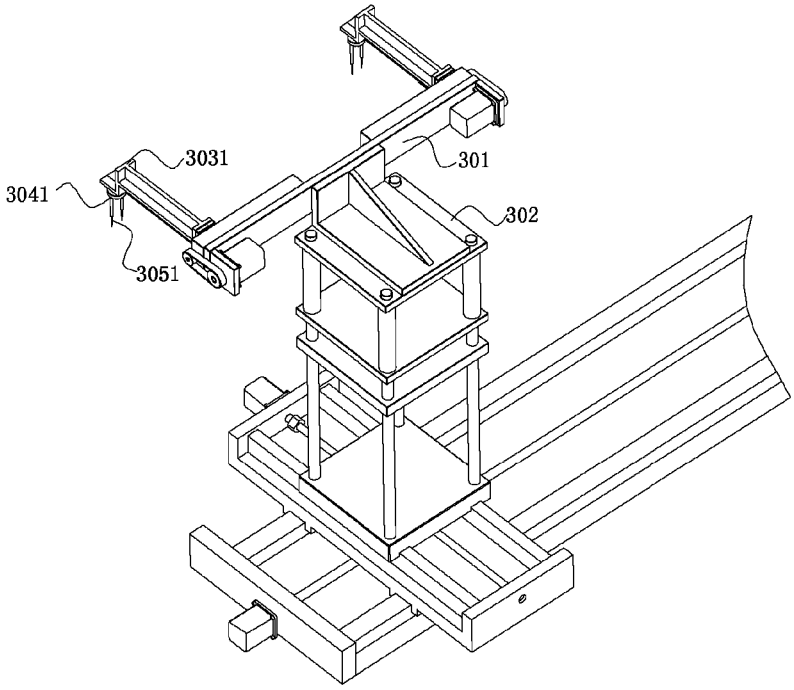
FIG. 7 shows the schematic view of the three-dimensional mobile platform.

As shown in FIG. 7, the seal strip pickup mechanism comprises:

- a supporting beam 301 fixed on the three-dimensional mobile platform 302;
- a first mechanical arm 3031 and a second mechanical arm 3032 that are slidably mounted on the supporting beam 301;
- a first rotary table 3041 and a second rotary table 3042 positioned on the first mechanical arm 3031 and the second mechanical arm 3032, respectively;
- a first pickup needle 3051 and a second pickup needle 3052 fixed on the bottom surface of the first rotary table 3041 and the second rotary table 3042, respectively.

The first pickup needle 3051 and the second pickup needle 3052 comprise two needles respectively so that the seal strip 110 can be kept in a fixed shape during moving instead of rotating around the pickup needle. Meanwhile, it can appropriately increase the friction between the pickup needle and the seal strip 110 so that the seal strip 110 will not fall off the pickup needle easily during the process of moving.

A pinhole 206 is positioned at the bottom surface of the seal strip receiving groove 103 to avoid the first pickup needle 3051 and the second pickup needle 3052.

Figure 8:
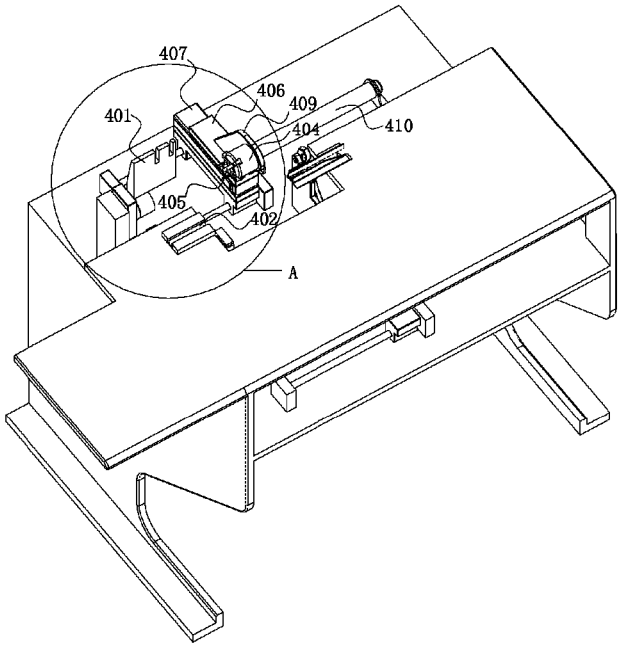
FIG. 8 shows the schematic view of the device for inwardly folding an edge of the seal strip.
Figure 9:
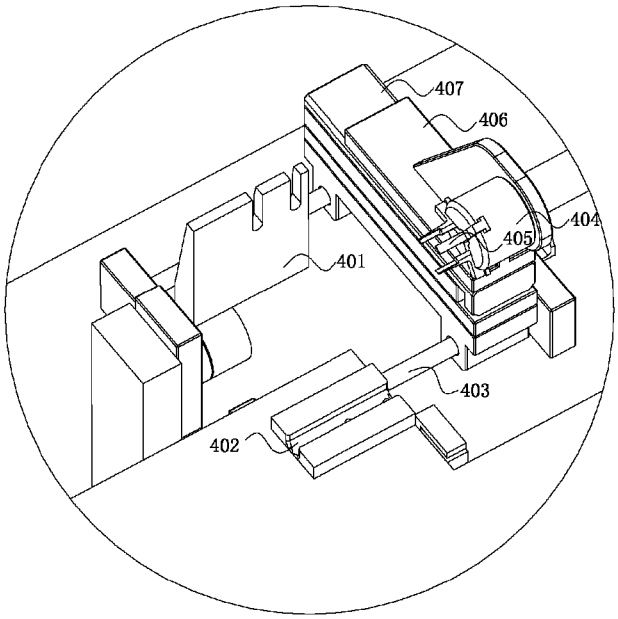
FIG. 9 shows the enlarged view of Part A in FIG. 8.
Figure 10:
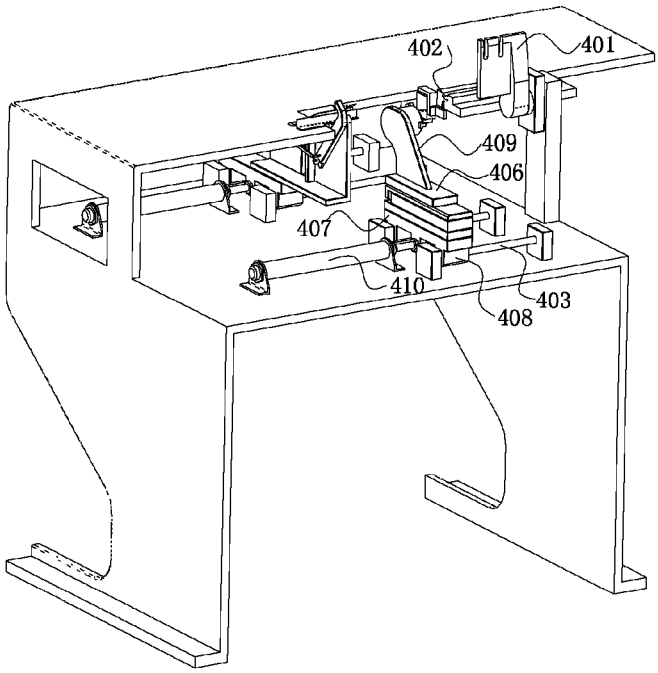
FIG. 10 shows the schematic view of the device for inwardly folding an edge of the seal strip (another viewing angle)
Figure 11:
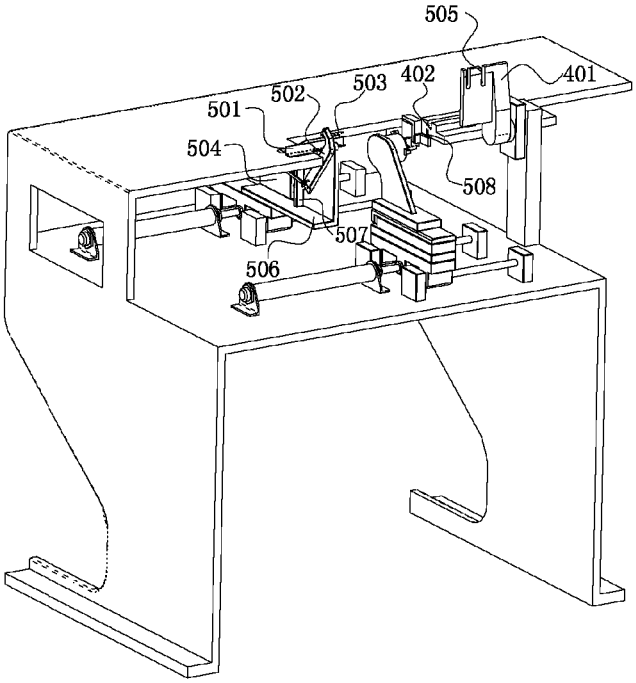
FIG. 11 shows the schematic view of the device for butt-joining the ends of the seal strip.

As shown in FIG. 8, FIG. 9 and FIG. 11, the device for inwardly folding an edge of the seal strip comprises a first fixture fixed on the rack to clamp the ends of the seal strip, a two-dimensional mobile platform slidably arranged on the rack, and a pneumatic jaw 404 fixed on the two-dimensional mobile platform which is provided with three chucks 405 driving ends of the seal strip to fold inwardly.

The chuck 405 is strip-shaped and its contact surface with the seal strip is a sunken cambered surface.

The two-dimensional mobile platform comprises a guide rod 403, a first sliding table 407 moving along the guide rod 403, a translation cylinder mounted on the first sliding table 407, and a second sliding table 406 fixed with the piston rod of the translation cylinder.

Moving direction of the piston rod of the translation cylinder is vertical to the guide rod 403, and the pneumatic jaw 404 is mounted on the second sliding table 406.

The guide rod 403 comprises two rods arranged in parallel and there are two sliding sleeves 408 matching with the two guide rods 403 respectively on the bottom surface of the first sliding table 407. There is also a thrust cylinder 410 on the rack to drive the first sliding table 407, with the piston rod of the thrust cylinder 410 connected with the bottom of the first sliding table 407 at the part between the two sliding sleeves 408.

The second sliding table 406 comprises a horizontal base fixed with the piston rod of the translation cylinder and a vertical support plate 409 perpendicularly fixed on the horizontal base, with the pneumatic jaw 404 mounted on the vertical support plate 409.

Figure 12:
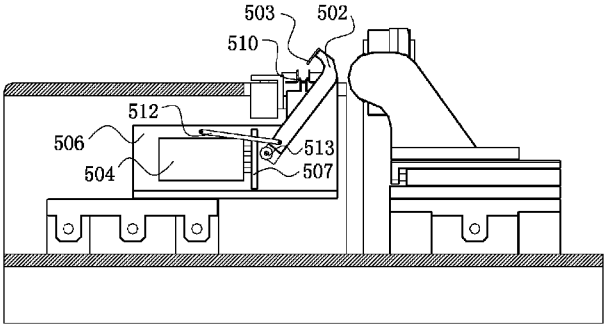
FIG. 12 shows the side view of the device for butt-joining the ends of the seal strip.
Figure 13:
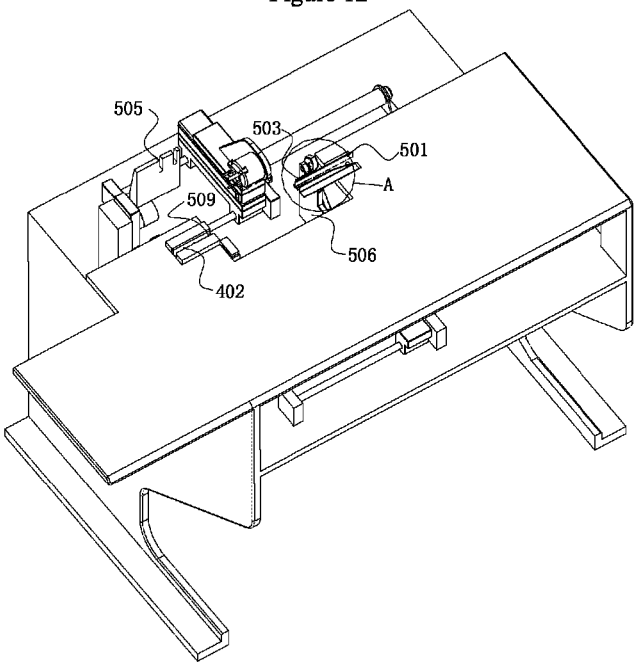
FIG. 13 shows the schematic view of the device for butt-joining the ends of the seal strip (another viewing angle)

As shown in FIG. 11, FIG. 12 and FIG. 13, the device for butt-joining the ends of the seal strip comprises a first fixture and a second fixture to clamp the first end and the second end of the seal strip respectively, wherein the first fixture comprises a limit slot 402 fixed on the rack and a clamp cover 401 hinged on the rack and matched with the limit slot 402; and the second fixture comprises two parallel limit strips 501 fixed on the rack, a mobile table 506 arranged on the rack, a lower chuck 510 fixed on the mobile table 506, a swinging arm 502 hinged with the mobile table 506 and an upper chuck 503 fixed at the free end of the swinging arm 502.

Figure 14:
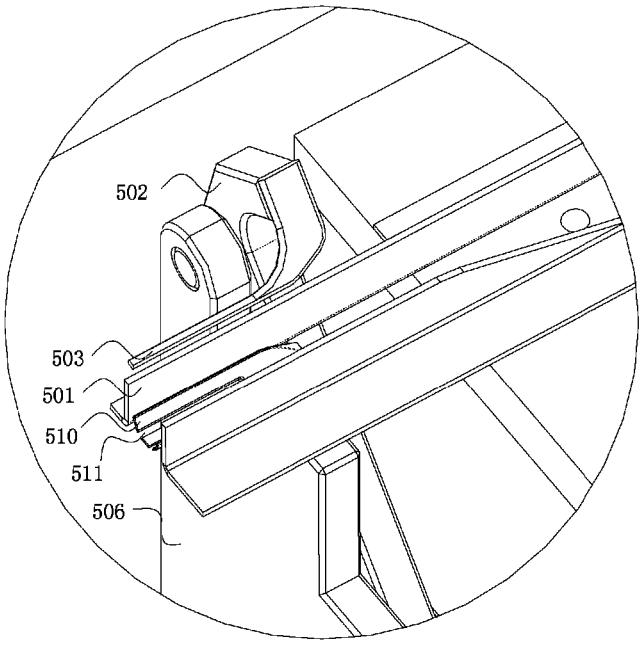
FIG. 14 shows the enlarged view of Part A in FIG. 13.

As shown in FIG. 13 and FIG. 14, the lower chuck 510 is an arc supporting spring positioned between the two limit strips 501, and the upper chuck 503 is rod-shaped, cooperates with the arc supporting spring to clamp the second end of the seal strip and gets into the first end of the seal strip along with the mobile table 506.

The middle part of the swinging arm 502 is hinged with the mobile table 506 by a revolving shaft, with one end being the free end mounted with the upper chuck 503 and the other end being the driving end. There is also an oscillating cylinder 504 on the mobile table 506, with the piston rod of the oscillating cylinder 504 connected and cooperated with the driving end of the swinging arm 502. There is a reset spring 512 connecting the mobile table 506 and the swinging arm 502.

The piston rod of the oscillating cylinder 504 pushes the driving end of the swinging arm 502 to move around the revolving shaft, with the free end of the swinging arm 502 moving correspondingly, which drives the upper chuck 503 on the free end of the swinging arm 502 to move and cooperate with the lower chuck 510 to clamp the second end of the seal strip.

A push plate 507 is fixed on the piston rod of the oscillating cylinder 504 and a fixed pulley 513 is arranged at the driving end of the swinging arm 502, with the push plate 507 being in contact with the outer circumference of the fixed pulley 513.

There is a lifting locating pin 508 at an opening of the limit slot 402 facing the second fixture, and there is a strip-type avoidance opening 511 on the arc supporting spring matching with the lifting locating pin 508, which is arranged along moving direction of the mobile table 506.

Figure 15:
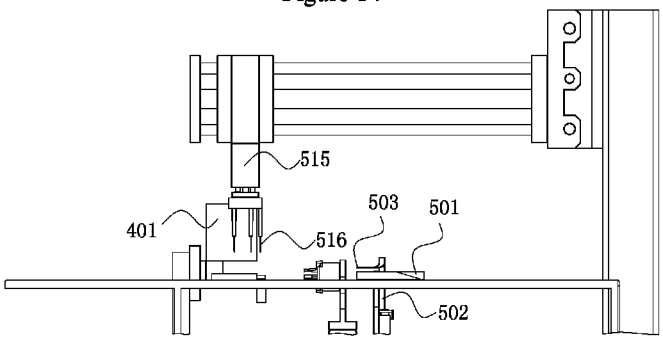
FIG. 15 shows the schematic view of the seal strip transferring mechanism of the device for butt-joining the ends of the seal strip.

As shown in FIG. 15, the device for butt-joining the ends of the seal strip also comprises a seal strip transferring mechanism which includes a three-dimensional moving arm 515 and a seal strip transfer needle 516 mounted on the three-dimensional moving arm 515.

There is an avoidance hole 509 matching with the seal strip transfer needle 516 on the bottom surface of the limit slot 402, and there is an avoid hole 505 matching with the seal strip transfer needle 516 on the clamp cover 401 so that the seal strip transfer needle 516 can pass through the seal strip.

Figure 16:
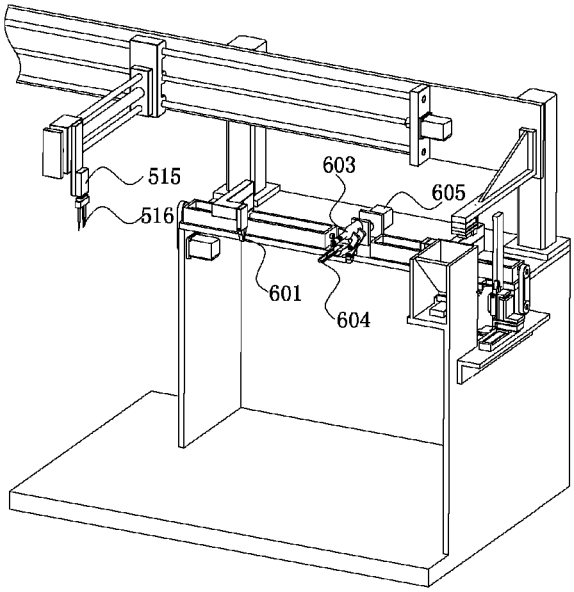
FIG. 16 shows the schematic view of the device for sewing the seal strip.
Figure 17:
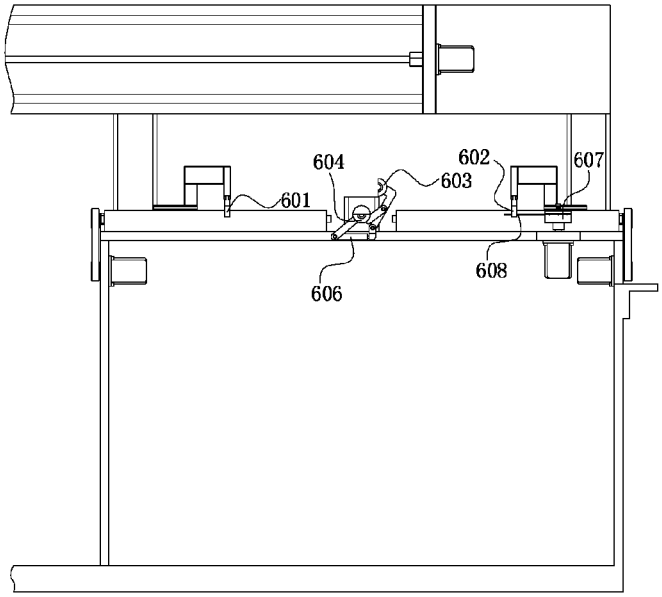
FIG. 17 shows the front view of the device for sewing the seal strip.
Figure 18:
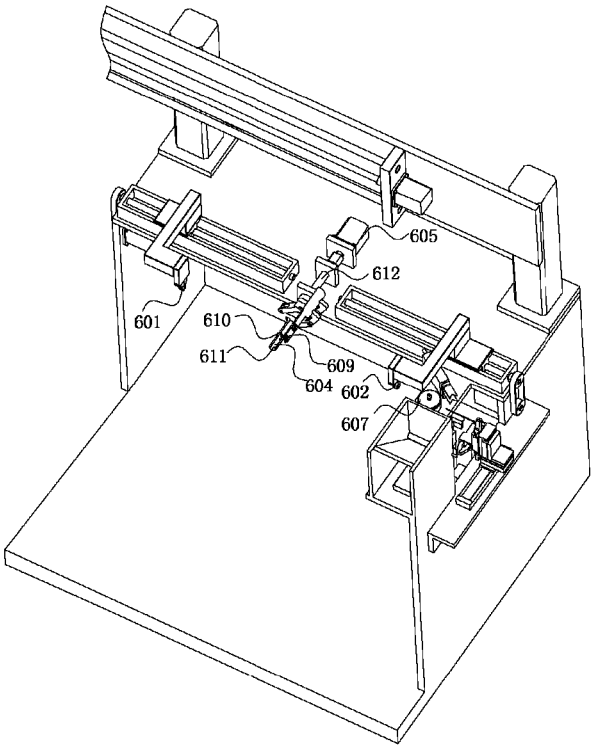
FIG. 18 shows the schematic view of the device for sewing the seal strip (another viewing angle)

As shown in FIG. 16, FIG. 17 and FIG. 18, the device for sewing the seal strip comprises a rotary fixture positioned on the rack to clamp the seal strip, a needle dial 607 mounted on the rack, a first clamping jaw 602 which picks sewing needle 608 from the needle dial 607 in sliding fit with the rack, and a second clamping jaw 601 which cooperates with the first clamping jaw 602 and pierces the seal strip with sewing needle 608 by turns in sliding fit with the rack.

The first clamping jaw 602 and the second clamping jaw 601 are positioned at each side of the rotary fixture and their moving paths are on the same straight line.

Figure 19:
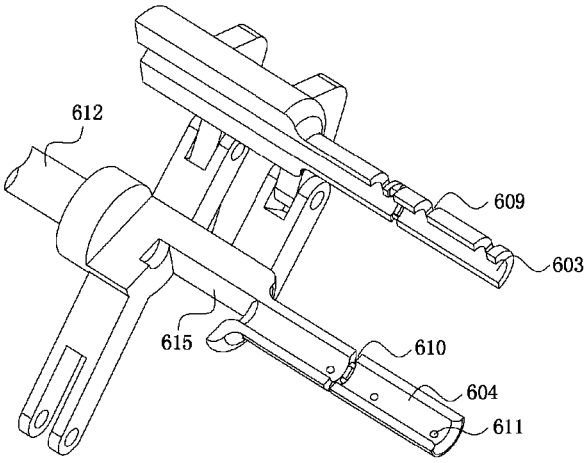
FIG. 19 shows the schematic view of the rotary fixture of the device for sewing the seal strip.
Figure 20:
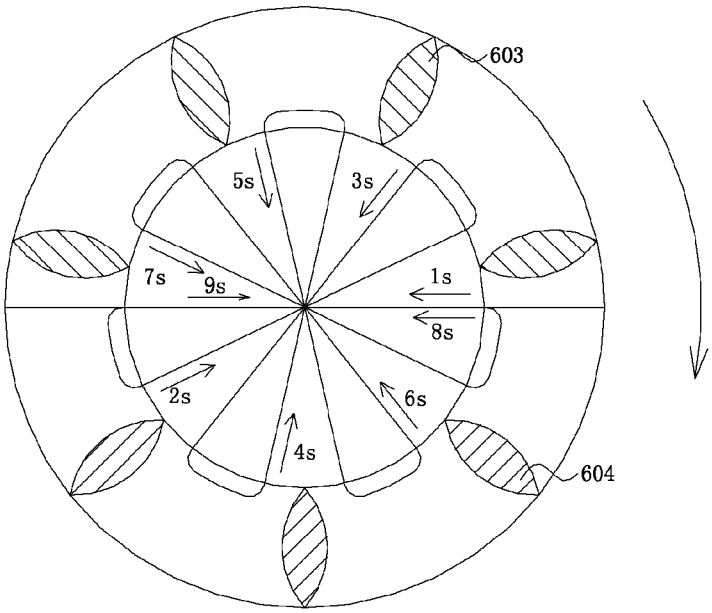
FIG. 20 shows the schematic view of the route of the sewing needle during the sewing process of the device for sewing the seal strip.

As shown in FIG. 19, the rotary fixture comprises a horizontally arranged main shaft 612 which is mounted on the rack via a support, an electric motor 605 fixed on the rack and used to drive the main shaft 612, a lower clamp plate 604 fixed with the main shaft 612, an upper clamp plate 603 hinged with the lower clamp plate 604, and a driving cylinder 606 used to drive the upper clamp plate 603 to flip relative to the lower clamp plate 604.

The upper clamp plate 603 and the lower clamp plate 604 are in matching semicircular cylinder shape and they can form a cylinder shape assorted with the seal strip after being merged, so that the seal strip is not liable to position shift during the process of sewing.

A sewing hole 610 for the sewing needle 608 is arranged on the upper clamp plate 603 and the lower clamp plate 604 so as to avoid the sewing needle 608.

An escape groove 615 is located at the joint part of the lower clamp plate 604 and the main shaft 612, to avoid the seal strip.

Figure 27:
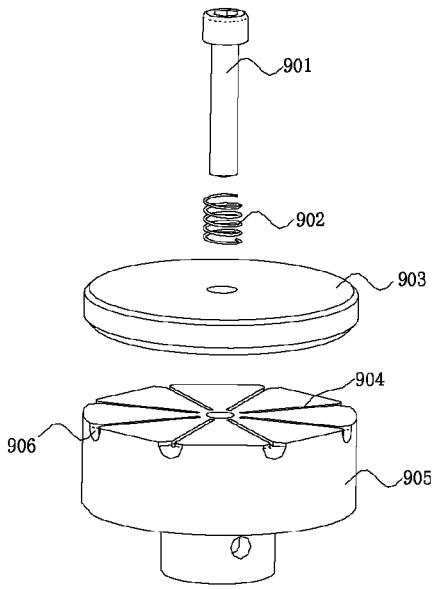
FIG. 27 shows the exploded view of the needle dial.

As shown in FIG. 27, a needle dial 607 is also arranged on the rack for placing sewing needles 608 after threading, comprising a needle dial body 905 and a needle dial cover 903, wherein the needle dial body 905 is disc-shaped with several needle holding grooves 904 arranged in radial direction on the top surface of the needle dial body 905, and a needle inserting mouth 906 on each needle holding groove 904 stretching to outer edge of the needle dial; and the needle dial cover 903 is positioned on the top surface of the needle dial body 905 by connector in coaxial.

The width of each needle holding groove 904 matches with the thickness of the sewing needle, and the depth of the needle holding groove 904 matches with the width of the sewing needle. There are a total of 8 needle holding grooves 904 which are distributed evenly around the axis of the needle dial body 905.

The needle inserting mouth 906 is a tapered flaring, and the edge of the needle dial cover 903 facing the needle dial body 905 is in chamfering or fillet structure.

The connector is a fastening bolt 901 through the axis of the needle dial cover 903 and the needle dial body 905, which is used to fix the needle dial cover 903 and the needle dial body 905 with a pre-loaded spring 902 on the fastening bolt 901.

The sewing needle 608 inserts into the needle holding groove via the needle inserting mouth 906 and the needle dial 607 rotates via the vertical revolving shaft, and rotates the needle holding groove with the sewing needle 608 to the appropriate position so that the first clamping jaw 602 can picks up the sewing needle 608 from the needle dial 607.

A needle passing hole 611 is arranged on the lower clamp plate 604 for passing of the seal strip transfer needle 516 and a needle avoiding tray 609 is positioned on the upper clamp plate 603 to avoid the seal strip transfer needle 516.

Figure 23:
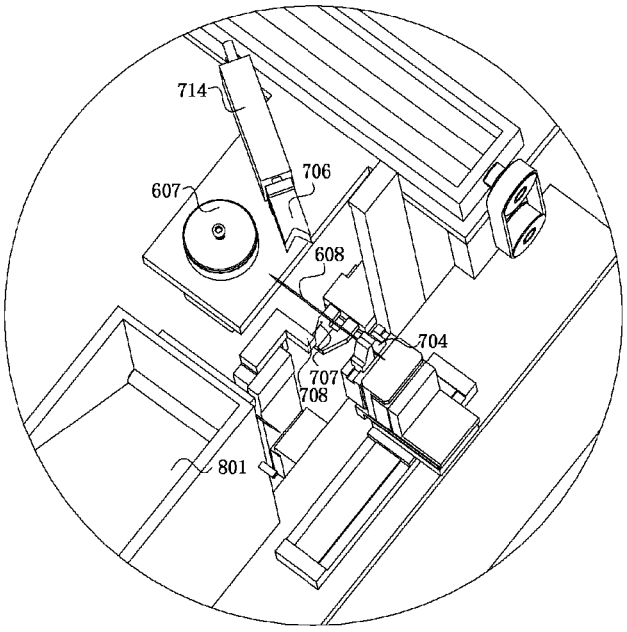
FIG. 23 shows the schematic view of the device for threading a needle for the seal strip (another viewing angle)

During the process of sewing, moving route of the sewing needle is as shown in FIG. 23, wherein 1s stands for the first needle and 2s signifies the second needle and so on, with arc arrows representing the direction of rotation of the rotary fixture.

Figure 28:
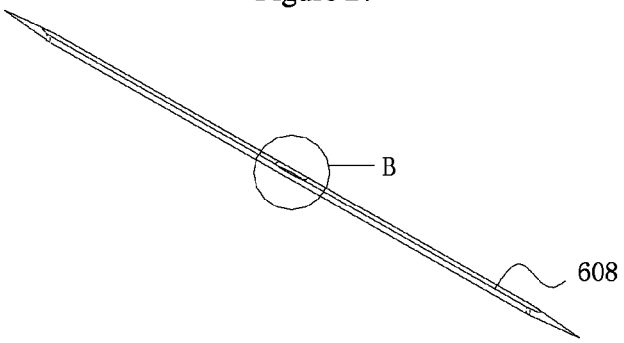
FIG. 28 shows the schematic view of the sewing needle.

As shown in FIG. 28, the sewing needle 608 for sewing the ends of the seal strip comprises a needle rod, needle tips at both ends of the needle rod, and a needle eye in the middle of the needle rod, wherein the length of the needle rod is 120 mm and section of the needle rod is rectangle with a long edge of 2.0 mm and a short edge of 1.0 mm, which could match with the conveying mechanism of the sewing needle 608. The opening of the needle eye is flaring.

Figure 21:
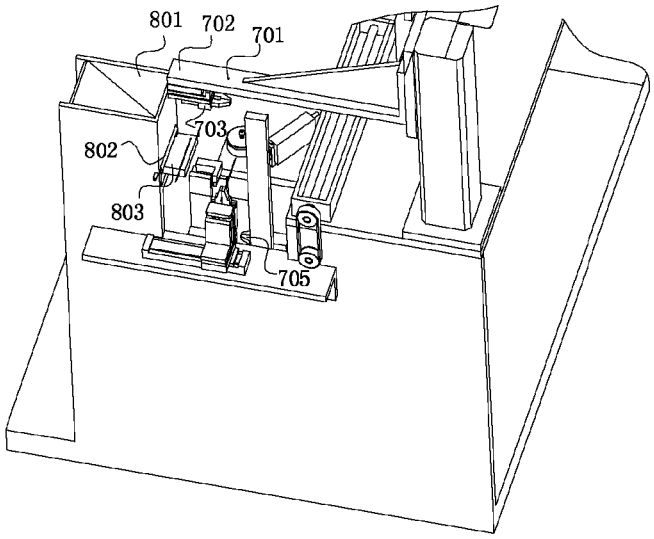
FIG. 21 shows the schematic view of the device for threading a needle for the seal strip.
Figure 22:
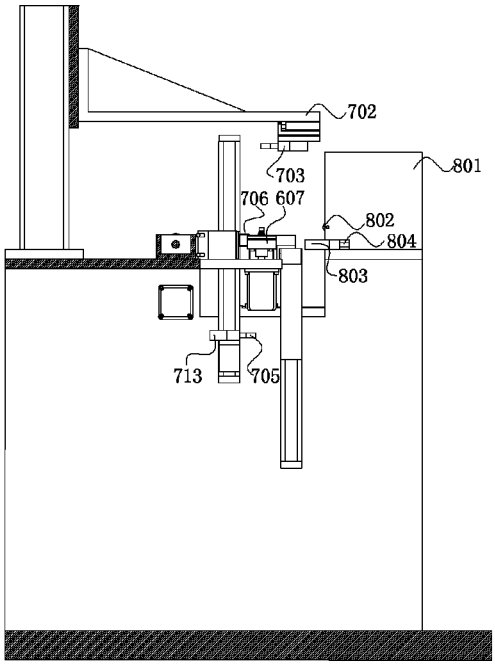
FIG. 22 shows the side view of the device for threading a needle for the seal strip.

As shown in FIG. 21, FIG. 22 and FIG. 23, the device for threading a needle for the seal strip comprises a sewing needle conveying mechanism, a three-dimensional mobile needle clamp 704 to fetch sewing needle 608 from the sewing needle conveying mechanism, a supporting jib arm 702 with a threading hole 701, a lead clamp 705 positioned under the supporting jib arm 702 to pull sewing thread from the threading hole 701, a hooked needle 707 to stretch into the sewing needle 608 eye to hook the sewing thread, and a pair of thread scissors 703, which is mounted on the supporting jib arm 702 to cut the sewing thread.

Figure 26:
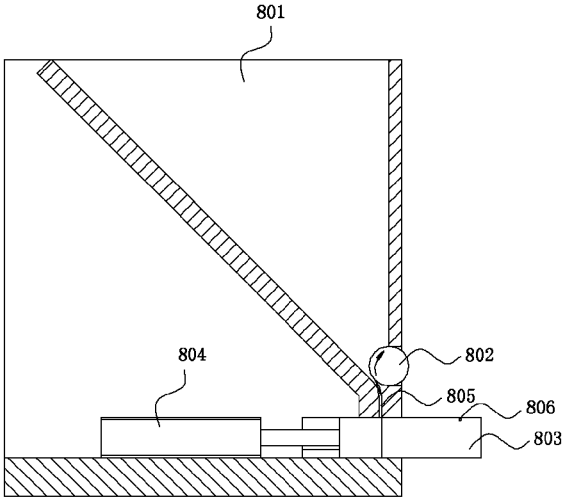
FIG. 26 shows the schematic view of the sewing needle conveying mechanism.

As shown in FIG. 26, the sewing needle conveying mechanism comprises a needle bin 801 for holding sewing needles, a needle tray 805 positioned at bottom of the needle bin 801 and matched with the size of a single sewing needle, a needle sweeping wheel 802 mounted on the side wall of the needle bin 801 by a revolving shaft, a needle pushing plate 803 arranged at the bottom of the needle tray 805, and a needle pushing cylinder 804, which drives the needle pushing plate 803 to move.

The needle sweeping wheel 802 is located at the top opening of the needle tray 805 and the width of the needle tray 805 is comparable to the thickness of the sewing needle (i.e. the width of the rectangular section of the sewing needle). Besides, there is a falling needle tray 806 on the top surface of the needle pushing plate 803 for receiving the sewing needle from the needle tray 805.

The needle bin 801 is an inverted cone with a top opening, and one side wall of the needle bin 801 is arranged vertically with the other side wall arranged obliquely and the needle sweeping wheel 802 is positioned on the vertically arranged side wall.

The obliquely arranged side wall has an included angle of 30-75° with the horizontal plane. The needle tray 805 is a strip-type tray and axis of the needle sweeping wheel 802 is parallel to the length direction of the needle tray 805. The strip-type needle tray 805 fits with the sewing needle in shape, which makes for adjustment of the sewing needle to match with position of the needle tray 805.

The sewing needle 608 is put in the needle bin 801, and the width of the needle tray is comparable to the thickness of the sewing needle 608. The needle sweeping wheel 802 keeps rotating, and the sewing needle 608 falls into the falling needle tray 806 via the needle tray only when the thickness and the direction of the sewing needle 608 exactly match with the needle tray, with the depth of the falling needle tray 806 matching with the width of the sewing needle 608 (i.e. the length of the rectangular section of the sewing needle) and the width of the falling needle tray 806 being able to hold only one sewing needle 608 each time. After the sewing needle 608 is positioned in the falling needle tray 806, the needle pushing cylinder 804 pushes the needle pushing plate 803 to move and drives the sewing needle 608 in the falling needle tray 806 to move to an appropriate position.

A lead clamp stand is arranged on the rack which is equipped with a slidably lifting base 713 and the lead clamp 705 is mounted on the lifting base 713.

A hooked needle stand 708 is slidably arranged on the rack and the hooked needle 707 is mounted on the hooked needle stand 708.

A telescopic cylinder 714 is positioned on the rack, and a thread pushing fork 706 is arranged at the end of the piston rod of the telescopic cylinder 714 to push the sewing thread in place on the hooked needle stand 707.

A slidable thread scissors base is arranged on the supporting jib arm 702 and the thread scissors 703 are mounted on the thread scissors base.

Figure 24:
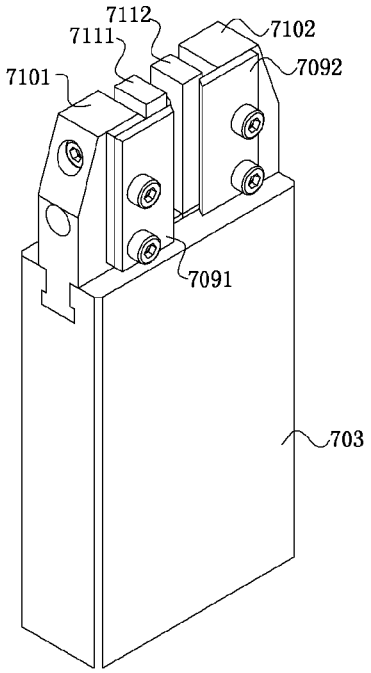
FIG. 24 shows the schematic view of the thread scissors of the device for threading a needle for the seal strip.
Figure 25:
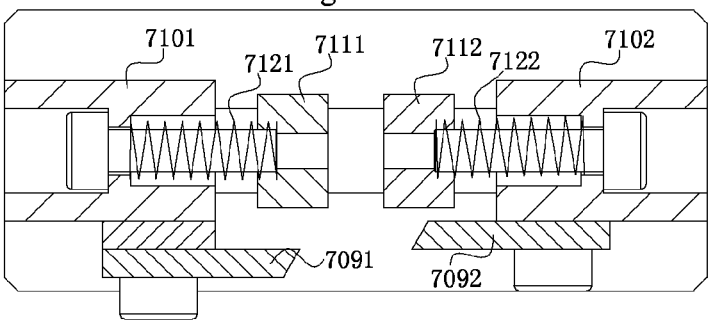
FIG. 25 shows the sectional view of the thread scissors of the device for threading a needle for the seal strip.

As shown in FIG. 24 and FIG. 25, the thread scissors 703 comprise a thread scissors cylinder fixed on the thread scissors base, a first clamp splice 7101 and a second clamp splice 7102 driven by the thread scissors cylinder, and a first blade 7091 and a second blade 7092 respectively fixed on the first clamp splice 7101 and the second clamp splice 7102.

A first clamping piece 7111 and a second clamping piece 7112 are respectively positioned at the opposite side of the first clamp splice 7101 and the second clamp splice 7102, and they are respectively connected with the first clamp splice 7101 and the second clamp splice 7102 via a first spring 7121 and a second spring 7122.

The interval between the first clamping piece 7111 and the second clamping piece 7112 is shorter than the interval between the first blade 7091 and the second blade 7092. Thus, when the thread scissors cylinder drives the first clamp splice 7101 and the second clamp splice 7102 to move face to face, the first clamping piece 7111 and the second clamping piece 7112 are in contact first to clamp the sewing thread. The thread scissors cylinder continues to drive the first clamp splice 7101 and the second clamp splice 7102 to move face to face, and the first blade 7091 and the second blade 7092 fixed on the first clamp splice 7101 and the second clamp splice 7102 are in contact and cut the sewing thread.

When threading a needle, the three-dimensional mobile needle clamp 704 fetches the sewing needle 608 from the sewing needle conveying mechanism and moves to the appropriate position, while the thread scissors base slides and drives the thread scissors 703 to slide, pull the sewing thread away from the threading hole 701. The lifting base slides upwards along the stand of the lead clamp 705 to above the thread scissors 703 and stops, while the thread scissors base resets under the threading hole 701. The lead clamp 705 clamps the sewing thread, the thread scissors 703 loosens the sewing thread and slides away from the threading hole 701 (to avoid the lead clamp 705), and the lifting base slides downwards along the stand of the lead clamp 705. The lead clamp 705 clamps the sewing thread and moves downwards to the appropriate position, the hooked needle stand 708 slides upwards along the rack to corresponding height of the sewing needle 608, with the eye of the hooked needle 707 aligned with the eye of the sewing needle 608, and the hooked needle stand 708 slides horizontally and drives the hooked needle 707 to pass through the eye of the sewing needle 608. Then, the telescopic cylinder on the rack drives the thread pushing fork 706 to move, pushes the sewing thread into the hooked needle 707, and the thread pushing fork 706 resets. The hooked needle stand 708 slides in reverse direction, pulls the sewing thread through the eye of the sewing needle 608, and the thread scissors cylinder drives the first clamp splice 7101 and the second clamp splice 7102 to move face to face, the first clamping piece 7111 and the second clamping piece 7112 clamp the sewing thread. Then, the thread scissors cylinder keeps carrying forward, and the first blade 7091 and the second blade 7092 fixed on the first clamp splice 7101 and the second clamp splice 7102 are in contact and cut the sewing thread. The hooked needle stand 708 slides downwards along the rack and drives one end of the cut sewing thread through the needle eye, and thus the sewing needle 608 finishing the threading. Then, the three-dimensional mobile needle clamp 704 finishes the alignment of the sewing needle 608 with the flaring of the needle inserting mouth 906, slides into the needle holding groove 904 along the flaring, and the needle dial cover 903 and the needle dial body 905 automatically clamp the sewing needle 608 under the action of the fastening bolt 901. The three-dimensional mobile needle clamp 704 loosens the sewing needle, the needle dial rotates to a fixed angle, and the first clamping jaw 602 grabs the part of the sewing needle 608 exposed outside the needle dial and takes it out.

The present invention also discloses a method for sewing the seal strip with the device for sewing the seal strip, comprising the following steps:

(1) the second fixture clamps the second end of the seal strip and extends into the first end of the seal strip to form an inserting part;

(2) positioning the inserting part in the rotary fixture, and the first clamping jaw clamps the sewing needle and penetrates the inserting part along the radial direction of the seal strip, while the second clamping jaw clamps the sewing needle and continues to move away from the rotary fixture;

(3) the rotary fixture rotates around its axis to the predetermined angle;

(4) the second clamping jaw clamps the sewing needle and penetrates the seal strip in the reverse direction, while the first clamping jaw clamps the sewing needle and continues to move away from the rotary fixture;

(5) repeating steps (2)-(4) until the sewing of the seal strip is completed.

The seal strip shall rotate 360° to finish the sewing, and the inserting depth and predetermined angle can be selected as required.

During operation of the device for sewing the seal strip, the seal strip is cut by the cutting machine, and moves along the conveying rolls 106 to the poking part which is positioned at one side of the supporting part 108 and extends between two adjacent conveying rolls 106. The piston rod of the flap plate cylinder 107 withdraws and drives the transmitting part 101 at the other side of the supporting part 108 to go down, while the poking part positioned at the other side of the supporting part 108 rises, throws the seal strip on the poking part onto the top surface of the guide plate 104, and the seal strip slides down into the seal strip receiving groove 103 at bottom edge of the guide plate 104 along the oblique top surface of the guide plate 104;

The seal strip in the seal strip receiving groove 103 is in contact with the lower pressure wheel 202 while the position sensor 201 senses the signal of the seal strip 110. After the sliding seat 207 assorted with the rack slides to the appropriate position, the lifting wheel seat 205 fixed on the sliding seat 207 goes down, with the upper pressure wheel 203 connected with the lifting wheel seat 205 by shaft going down correspondingly, which makes the position of the upper pressure wheel 203 matching that of the lower pressure wheel 202, so that they clamp the seal strip 110 in cooperation. The driving mechanism 204 drives the lower pressure wheel 202 to rotate in opposite direction and drives the upper pressure wheel 203 to rotate, which makes the seal strip 110 move face to face under clamping and transmission of the first pressure wheel and the second pressure wheel. Both ends of the seal strip 110 get close to the middle and the middle part of the seal strip 110 hangs down from the seal strip holding opening 109 due to the action of gravity until the position sensor 201 cannot sense signal of the seal strip 110 anymore (i.e. ends of the seal strip 110 have arrived at the appointed position). The position sensor 201 gives control signal to the driving mechanism 204 of the lower pressure wheel 202 to stop rotation of the lower pressure wheel 202, and the upper pressure wheel 203 stops rotating meanwhile with both ends of the seal strip 110 stopping moving. After the three-dimensional mobile platform 302 moves to the appropriate position above the seal strip 110, the supporting beam 301 goes down with the first pickup needle 3051 and the second pickup needle 3052 respectively piercing each end of the seal strip 110, and the lifting wheel seat 205 rises and the upper pressure wheel 203 on the lifting wheel seat 205 rises correspondingly. The sliding seat 207 drives the lifting wheel seat 205 away from the seal strip receiving groove 103 and the supporting beam 301 rises. After the first mechanical arm 3031 and the second mechanical arm 3032 slides face to face with a distance being less than the length of the strip-type notch, they stop sliding while the first rotary table 3041 and the second rotary table 3042 rotate for 180°, being corresponding to the ends of the seal strip 110, and thus positioning of the ends of the seal strip 110 being finished.

The three-dimensional mobile platform 302 moves above the device for positioning the ends of the seal strip and the supporting beam 301 goes down. The first end of the seal strip is positioned in the limit slot 402, and the clamp cover 401 flips and, in cooperation with the limit slot 402, clamps the first end of the seal strip. Meanwhile, the second end of the seal strip is positioned between the two limit strips 501, which means, on the arc supporting spring, and the swinging arm 502 rotates, driving the upper chuck 503 at free end of the swinging arm 502, in coordination with the lower chuck 510, and clamps the second end of the seal strip.

The first sliding table 407 moves towards the ends of the seal strip in the limit slot 402 along the guide rod 403 to the appropriate position, and the translation cylinder drives the second sliding table 406 to move, while the pneumatic jaw 404 fixed on the second sliding table 406 moves to the position corresponding to ends of the seal strip. Then, a chuck 405 of the pneumatic jaw 404 clamps ends of the seal strip, and the first sliding table 407 continues sliding along the guide rod 403, drives the chuck 405 clamping the ends of the seal strip extend into interior of the seal strip, and thus outer layer of the seal strip being introverted inside. After inwardly folding an edge of the seal strip, the first sliding table 407 slides along the guide rod 403 in reverse direction and the pneumatic jaw 404 moves out of the ends of the seal strip, while the translation cylinder drives the second sliding table 406 to reset and wait for the next cycle.

The mobile table 506 moves, driving the second end of the seal strip into the first end of the seal strip to form an inserting part, and the lifting locating pin 508 rises, passes through the strip-type avoid opening 511 on the arc supporting spring, pierces the seal strip and fixes the inserting part of the first end and the second end of the seal strip. The oscillating cylinder 504 resets and the swinging arm 502 resets under the action of the reset spring 512, while the mobile table 506 moves, driving the upper chuck 503 and the lower chuck 510 withdraw from the seal strip. After the upper chuck 503 and the lower chuck 510 completely withdraw from the seal strip, the upper chuck 503 resets under the action of the reset spring 512, and the three-dimensional moving arm 515 moves to the appropriate position above the seal strip and lowers. The seal strip transfer needle 516 mounted on the three-dimensional moving arm 515 pierces the inserting part of the first end and the second end of the seal strip and the clamp cover 401 flips and opens, while the three-dimensional moving arm 515 rises and the seal strip transfer needle 516 drives the seal strip to transfer to the device for sewing the seal strip;

The three-dimensional moving arm 515 transfers the inserting part of the seal strip to the lower clamp plate 604 and the seal strip transfer needle 516 passes through the needle passing hole 611 on the lower clamp plate 604, while the driving cylinder 606 drives the upper clamp plate 603 to flip relative to the lower clamp plate 604 and clamp the butt-joining part of the seal strip together with the upper clamp plate 603. The first clamping jaw 602 picks a sewing needle 608 from the needle dial 607, slides and pierces the butt-joining part of the seal strip with the sewing needle 608. The second clamping jaw 601 clamps the sewing needle 608 and threads across one end of the seal strip, while the first clamping jaw 602 loosens the sewing needle 608 and the second clamping jaw 601 clamps the sewing needle 608, slides away from the seal strip for a certain distance, and immediately returns. Meanwhile, the main shaft 612 is driven by the electric motor 605 to rotate and drives the rotary fixture to rotate for a fixed angle, then, the second clamping jaw 601 pierces the inserting part of the seal strip with the sewing needle 608 and the first clamping jaw 602 clamps the other end of the sewing needle 608, while the second clamping jaw 601 loosens the sewing needle 608 and the first clamping jaw 602 clamps the sewing needle 608, slides away from the seal strip for a certain distance, and immediately returns when the rotary fixture rotates to a certain angle. This process repeats again and again until sewing of the butt-joining part of the seal strip is finished. After the last sewing, the first clamping jaw 602 clamps the sewing needle 608, tensions the sewing thread, and the sewing needle 608 drops automatically, with the first clamping jaw 602, the second clamping jaw 601 and the rotary fixture being reset.

The invention claimed is:

1. A device for sewing a seal strip comprising a tubular seal strip body with a first end and a second end, wherein the first end extends into the second end and is securely connected to the second end by a sewing thread, including a rack, wherein the device comprises:

a first device for positioning the ends of the seal strip to position the first end and the second end of the seal strip; and a second device for butt-joining the ends of the seal strip, comprising a first fixture and a second fixture to clamp the first end and the second end of the seal strip respectively, wherein the first fixture comprises:

a limit slot fixed on the rack; and a clamp cover hinged on the rack and matched with the limit slot;

the second fixture comprises:

two parallel limit strips fixed on the rack;

a mobile table arranged on the rack;

a lower chuck fixed on the mobile table, which is an arc supporting spring positioned between the two limit strips;

a swinging arm hinged with the mobile table;

an upper chuck fixed at free end of the swinging arm, which is rod-shaped, cooperates with the arc supporting spring to clamp the second end of the seal strip and gets into the first end of the seal strip along with the mobile table;

a means for sewing the seal strip, comprising a rotary fixture positioned on the rack to clamp the seal strip;

a needle dial mounted on the rack;

a first clamping jaw, which picks sewing needle from the needle dial in sliding fit with the rack;

a second clamping jaw, which cooperates with the first clamping jaw and pierces the seal strip with sewing needle by turns in sliding fit with the rack.

2. The device for sewing the seal strip according to claim 1, wherein it is equipped with a seal strip feeding machine which provides seal strips to the device for positioning the ends of the seal strip, comprising:

a plurality of multiple parallel arranged conveying rolls connected on the rack by shaft;

a guide plate obliquely fixed on the rack;

a flap plate hinged with the rack, which is used to move the seal strip on the conveying rolls onto a top surface of the guide plate; and a seal strip receiving groove located at bottom edge of the guide plate.

3. The device for sewing the seal strip according to claim 2, wherein the device for positioning the ends of the seal strip comprises:

a seal strip receiving groove fixed on the rack;

two pressure wheels mounted on the rack and used to clamp and deliver the seal strip, with opposite delivering directions;

a seal strip holding opening positioned at bottom surface of the seal strip receiving groove;

a three-dimensional mobile platform arranged on the rack; and a seal strip pickup mechanism fixed on the three-dimensional mobile platform.

4. The device for sewing the seal strip according to claim 3, wherein it is equipped with a device for inwardly folding the second end of the seal strip, comprising:

a two-dimensional mobile platform slidably arranged on the rack; and a pneumatic jaw fixed on the two-dimensional mobile platform, which is provided with at least three chucks driving ends of the seal strip to fold inwardly.

5. The device for sewing the seal strip according to claim 4, wherein it is equipped with a device for threading a needle for the device for sewing the seal strip, comprising:

a sewing needle conveying mechanism;

a three-dimensional mobile needle clamp to fetch sewing needle from the sewing needle conveying mechanism;

a supporting jib arm with a threading hole;

a lead clamp positioned under the supporting jib arm to pull sewing thread from the threading hole;

a hooked needle to stretch into the sewing needle eye to hook the sewing thread; and a pair of thread scissors, which is mounted on the supporting jib arm to cut the sewing thread.

6. The device for sewing the seal strip according to claim 5, wherein the sewing needle comprises a needle rod, needle tips at both ends of the needle rod, and a needle eye in the middle of the needle rod, wherein the section of the needle rod is rectangle.

7. The device for sewing the seal strip according to claim 6, wherein the sewing needle conveying mechanism comprises:

a needle bin for holding sewing needles;

a needle tray positioned at bottom of the needle bin and matched with the size of a single sewing needle;

a needle sweeping wheel mounted on the side wall of the needle bin by a revolving shaft, which is located at a top opening of the needle tray;

a needle pushing plate arranged at a bottom of the needle tray, which is equipped with a falling needle tray on the top for receiving the sewing needle from the needle tray; and a needle pushing cylinder, which drives the needle pushing plate to move.

8. A method for sewing the seal strip with the device for sewing the seal strip according to claim 1, wherein the following steps are comprised:

(1) the second fixture clamping the second end of the seal strip and extending into the first end of the seal strip to form an inserting part;

(2) positioning the inserting part in the rotary fixture, and the first clamping jaw clamping the sewing needle and penetrating the inserting part along the radial direction of the seal strip, while the second clamping jaw clamping the sewing needle and continues to move away from the rotary fixture;

(3) the rotary fixture rotating around its axis to the predetermined angle;

(4) the second clamping jaw clamping the sewing needle and penetrating the seal strip in the reverse direction, while the first clamping jaw clamping the sewing needle and continuing to move away from the rotary fixture;

(5) repeating steps (2)-(4) until the sewing of the seal strip is completed.

* * * * *